US011844372B1

(12) United States Patent
Alkum et al.

(10) Patent No.: US 11,844,372 B1
(45) Date of Patent: Dec. 19, 2023

(54) HOOKAH HEAD

(71) Applicant: 4D Signs Express Inc, Clifton, NJ (US)

(72) Inventors: Ahmad Alkum, Boonton, NJ (US); Nael Azazi, Boonton, NJ (US); Ahmed Shaikh, Boonton, NJ (US)

( * ) Notice: Subject to any disclaimer, the term of this patent is extended or adjusted under 35 U.S.C. 154(b) by 0 days.

(21) Appl. No.: 18/205,137

(22) Filed: Jun. 2, 2023

(51) Int. Cl.
*A24F 1/30* (2006.01)
*A24F 1/32* (2006.01)
*A24F 5/04* (2006.01)

(52) U.S. Cl.
CPC ..... *A24F 1/30* (2013.01); *A24F 1/32* (2013.01); *A24F 5/04* (2013.01)

(58) Field of Classification Search
CPC ..... A24F 1/30; A24F 1/32; A24F 5/04
See application file for complete search history.

(56) References Cited

U.S. PATENT DOCUMENTS

2010/0083973 A1* 4/2010 Zoumut ..... A24F 1/30 131/173
2015/0068540 A1* 3/2015 Hoch ..... A24F 7/02 131/173
2016/0143352 A1* 5/2016 Bavar ..... A24F 5/14 131/226
2016/0157520 A1* 6/2016 Alfawaz ..... A24F 1/30 131/226
2022/0079249 A1* 3/2022 Wang ..... A24F 42/60

* cited by examiner

*Primary Examiner* — Michael H. Wilson
*Assistant Examiner* — Stephanie Lynn Moore
(74) *Attorney, Agent, or Firm* — Joshua Kaplan, Esq; Kaplan Law Practice, LLC

(57) ABSTRACT

The specification discloses a hookah head defined by a sidewall. The sidewall has a bottom end and a top end. The top end forms an upper surface, which preferably is made of metal. An air channel runs from the upper surface to the bottom end of the body. The air channel has a top end corresponding to the upper surface and a bottom end that corresponds to the bottom end of the body. The interior wall forms the cylinder that defines the air channel. The body of the hookah head defines a cavity configured to contain a quantity of liquid. The bottom end of the air channel is configured to be fitted on top of an air channel of the hookah body, with the air channel of the hookah head then having air communication with the grommet of the hookah device.

20 Claims, 9 Drawing Sheets

HOOKAH HEAD

FIELD OF THE INVENTION

The present invention relates to an accessory device for hookahs, namely a hookah head.

BACKGROUND OF THE INVENTION

Traditional hookah devices generally include a thin dish of perforated metal, a wire mesh layer, or a layer of aluminum foil for supporting charcoal. This layer sits atop a hookah bowl (also known as a hookah head). A Hookah head or bowl receives a quantity of shredded or crushed herbal matter, such as herbs or tobacco, which may additionally contain flavored ingredients. The hookah head is mounted on a pipe that leads to a body containing a quantity of liquid for smoke filtration, and a including an internal pipe, a base for containing water, and a hose with a mouthpiece. The hose is typically attached to the body such that it has an airtight connection with air above the water in the base.

Typically, a user will first partially fill the base with water and then place the internal pipe into the water such that the body creates an airtight seal with the base. The head or bowl is then filled with tobacco and placed over the internal pipe such that an airtight seal is created between the internal pipe and the bowl. Next the user places the foil layer over the bowl, places one or more lit charcoals on the foil layer and these charcoals serve to heat the herbal matter underneath the foil layer. The plurality of perforations or a wire mesh comprising the foil layer serve as air holes that direct the heat from the burning coal into the herbal matter in the bowl while keeping the actual charcoal particles away from the bowl and the herbal matter.

When the user inhales via the hose, ambient air is pulled through the charcoals and into the hookah head via the air holes in the foil layer. The drawn air is heated by the charcoals and burns the herbal matter (and any of the present, optional flavoring ingredients), thereby producing (flavored) smoke. The produced smoke is further drawn from the bowl through the internal pipe, through the water contained in the base (where the smoke gains moisture and is cooled down), through the hose and into the user's mouth.

Traditional bowls, sometimes referred to as "Egyptian" hookah bowls, are most notably characterized by having several small holes in the bottom of the bowl that the tobacco is packed on top of. They are most commonly made of clay, although other materials may be used.

One common method of enhancing or flavoring a smoke is by dividing a fruit into two and boring a hole through the center of one of the halves. An amount of herbal smoking payload is placed at the top of one of the halves, around the central hole. The fruit is then placed on top of the bawl, or is used instead of the bawl, with the foil layer deployed directly over the fruit.

One drawback of using a fruit, is that a user must have a quantity of the fruit since the flavoring benefits of a real fruits dissipate quickly, requiring reloading of fruit and resetting of the hookah device. A user must also have tools on hand for cutting, drilling/perforating, and be willing to clean up the resulting mess. This may be quite an undertaking for an ordinary smoke and is therefore usually reserved for special occasions.

Another problem with traditional bowls is that the added flavorings take up space in the bowl, thereby reducing the amount of tobacco that can be filled per use.

Still another problem with traditional heads is that relatively newer users might add too much or too little flavorings, resulting in inconsistent flavoring of the tobacco.

The foregoing drawbacks demonstrate a need for a hookah head that offers traditional loading chamber for the herbal matter being smoked, but which may also produce consistent and long-lasting flow or flavoring.

SUMMARY OF THE INVENTION

The present invention discloses a hookah head formed by a body having a sidewall. The sidewall has a bottom end and a top end. The top end forms an upper surface, which preferably is made of a metal material. An air channel runs from the upper surface to the bottom end of the body. The air channel has a top opening corresponding to the upper surface and a bottom opening that corresponds to the bottom end of the body. The interior wall shaped substantially as a cylinder defines the air channel. The body of the hookah head between the sidewall and the interior wall defines a cavity that is preferably filled with a quantity of liquid. The bottom end of the air channel is configured to be fitted on top of an air channel of the hookah body, with the bottom opening of the air channel of the hookah head then having air communication with the grommet of the hookah device, which leads directly to the hookah pipe that is in communication with the hookah bottle.

It is preferable that the side wall and the interior wall are made from a silicone, polyurethane or resin composition that is impregnated with a sent or a combination of scents. It is further preferable that the sidewall's malleability mimics the consistency of the fruit peel of the fruit that is being impersonated.

It is also preferable that the upper surface further comprises a first rim and a second rim. The upper surface forms a band around the upper opening of the air channel, with the first rim defining the upper opening of the air channel. The second rim, which may be a protrusion of the sidewall above the upper surface, then foul's the circumference around the upper surface, and is oriented to be in a parallel and spaced apart position along the upper surface relative to the first rim. The second rim may additionally contain a second rim extension that can be removable, and which may be used to increase the holding capacity of the upper surface between the first and second rims to hold a quantity of herbal material.

The upper end of the air channel may additionally contain a concave opening formed by a mesh surface which is utilized to prevent the smoking payload or the herbal material from falling into the air channel.

Stated differently, the hookah bowl assembly comprises a hemispherical-shaped bowl head and a bowl dish. The bowl head comprises a vertical central channel having an inlet and an outlet, and an upper surface. The upper surface comprises a generally concave-shaped central cavity, a generally convex-shaped central rim surrounding the central cavity and having an outer perimeter, a generally concave toroidal-shaped upper lateral cavity surrounding the central rim, and an outer upper rim surrounding the upper lateral cavity. The bowl dish comprises an outer base and a circular bowl dish stem. The circular outer base comprises an outer wall, an inner wall, and a floor between the outer wall and the inner wall. The inner wall defines a central aperture. The circular bowl dish stem comprises a central concave-shaped mesh screen, a circular lateral base having an outer edge, and a descending outer wall depending on the outer edge. The outer wall of the dish stem is coupled to the outer perimeter of the central rim. The mesh screen of the dish stem is communication with the central cavity of the upper surface. The central aperture is in air communication with the central cavity, and the central cavity is in air communication with the central channel, the result of which is that the central aperture, central cavity and central channel form an air channel through the bowl head and said bowl dish.

In one embodiment, the bowl head comprises a silicone composition. In one embodiment, the bowl dish comprises a metal or a metal alloy composition. In one embodiment, the bowl head and the bowl dish are integrally formed. In one embodiment, the hookah bowl assembly further comprises an extension rim having a lower end. The lower end of the extension rim is detachably coupled to the outer upper rim of the bowl head. In one embodiment, the bowl head further comprises a tubular inner wall forming the central channel, and a generally toroidal-shaped lower cavity defined by the space beneath the upper surface and between the outer wall and the inner wall.

The inner cavity of the bowl head may be refillable. For example, by inserting a needle through the side wall. In one embodiment, the scent comprises a combination of scents. In one embodiment, the bowl head has an outer wall shaped and textured so as to resemble a fruit. In one embodiment, the outlet of the central channel is configured to detachably couple to a bowl grommet of the hookah device. In one embodiment, the central channel is conical.

The ring forming the second rim may be formed from one or more sections linked together.

BRIEF DESCRIPTION OF THE DRAWINGS

The accompanying figures illustrate several embodiments of the invention and, together with the description, serve to explain the principles of the invention. One of ordinary skill in the art readily recognizes that the particular embodiments illustrated in the figures are merely exemplary and are not intended to limit the scope of the present invention.

DESCRIPTION OF THE PREFERRED EMBODIMENTS

Figure 1:
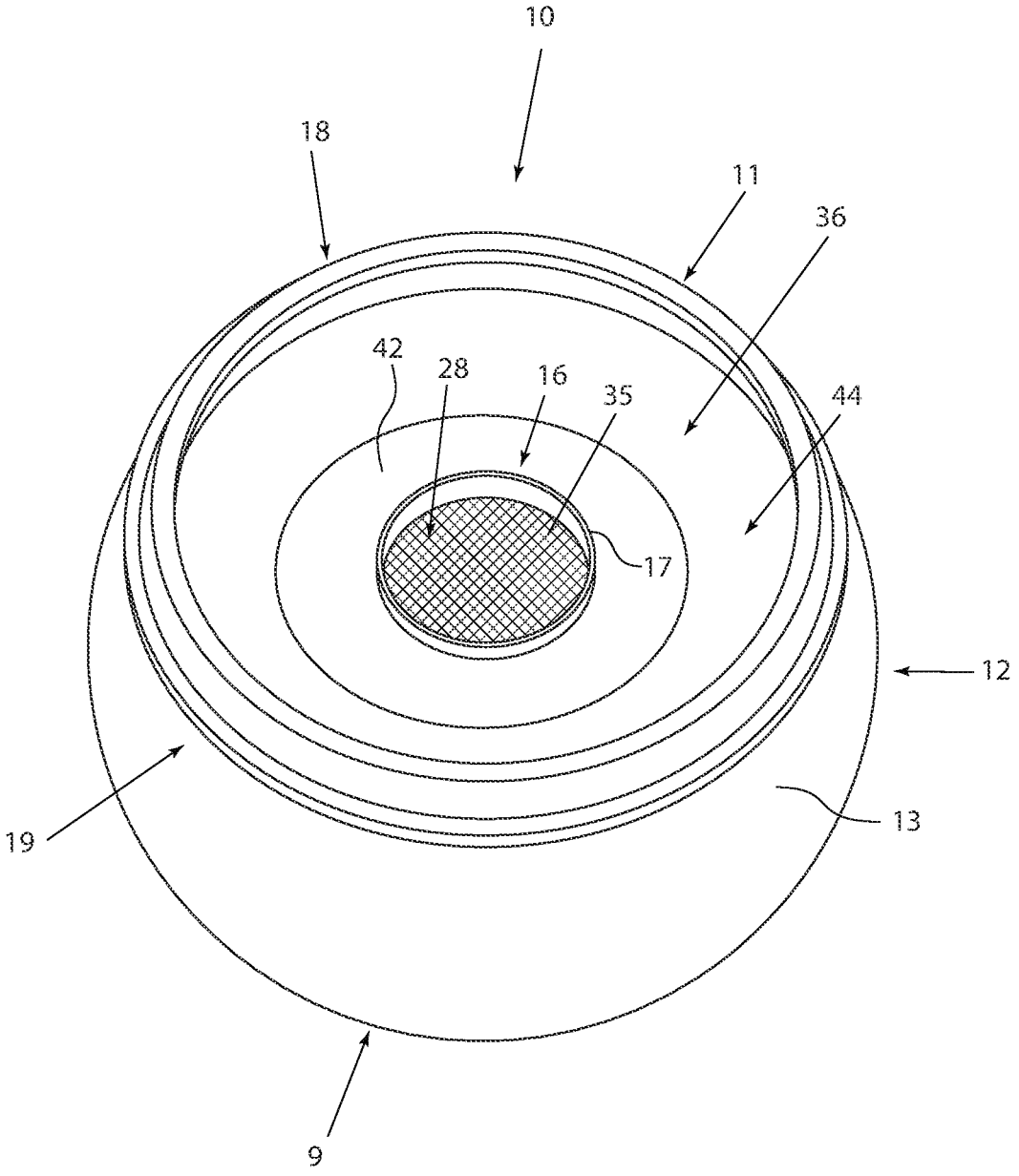
FIG. 1 is a perspective view of a hookah bowl assembly according to one embodiment of the present invention.

The preferred embodiments of the present invention will now be described with reference to the drawings. Identical elements in the various figures are identified with the same reference numerals.

Reference will now be made in, detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Reference will be made in detail to the embodiments of the disclosure, examples of which are illustrated in the accompanying drawings. The presentation of reference numerals within parentheses indicates that the mentioned reference numeral appears in a figure other than the figure(s) under discussion.

As will be described below in connection with the drawings, the invention provides a hookah bowl assembly 10 capable of carrying or holding a smoking payload or herbal matter or flavoring/scenting tobacco to be smoked. FIG. 1 illustrates, according to one embodiment, a hookah bowl assembly 10 comprising a bowl body 12, a top surface 36 and an extension rim 18 (see also FIG. 3). A quantity of herbal material, such as tobacco, or other herbs used for smoking is heaped (e.g., sprinkled) over the entire top surface 36 in the area outside of top opening 16. The top surface 36 may be further comprised of an outer base 42 and a dish sidewall 44, separated by a groove 41. Alternatively, groove 41 represents the trough of the top surface 36 and may be less pointed and shaped in the form of a channel. The function of groove 41 is to increase the payload quantity of the smoking composition placed on the top surface 36.

Figure 3:
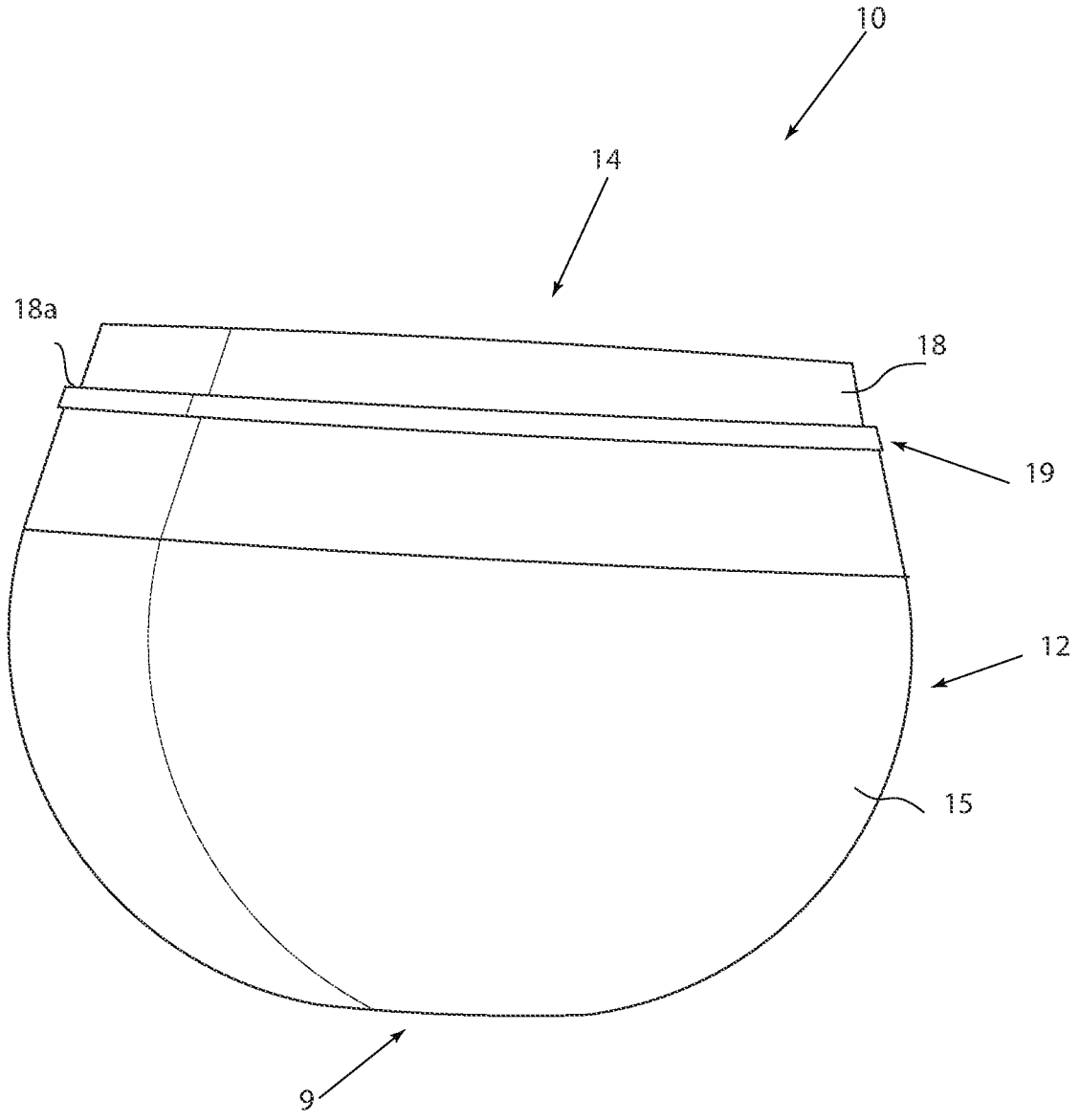
FIG. 3 is a side view of a hookah bowl assembly according to one embodiment of the present invention showing an extension rim.

Shown in FIGS. 1 and 3 is the extension rim 18 which removably mounts on top of the second rim 19. The function of extension rim 18 is to increase the payload holding capacity (of smoking payload) of bowl 12 by raising the outer edge (18 and 19) above the surface of the top surface 36. In another embodiment, extension rim 18 is integrally formed with bowl 12. Preferably, together with sidewall 13. Also shown is the first rim 17 which defines the top opening 16 of air channel 28. The space between the first rim 17 and the second rim 19, which are in a parallel and spaced apart orientation with each other makes the top surface 36, which is preferably made out of metal or metal allow but may also be made from the same material as the sidewall 13 or made from wood or fabric. The first rim 17 prevents the smoking payload resting on the top surface 36 from dropping into the top opening 16. The top opening 16 is further protected by a mesh, such as a wire or fabric mesh 35. It should be noted that while air channel 28 is shown to be substantially centrally located within body 12 and running from the top end to the bottom end 9 of body 12, it may be located somewhat to the side.

Figure 2:
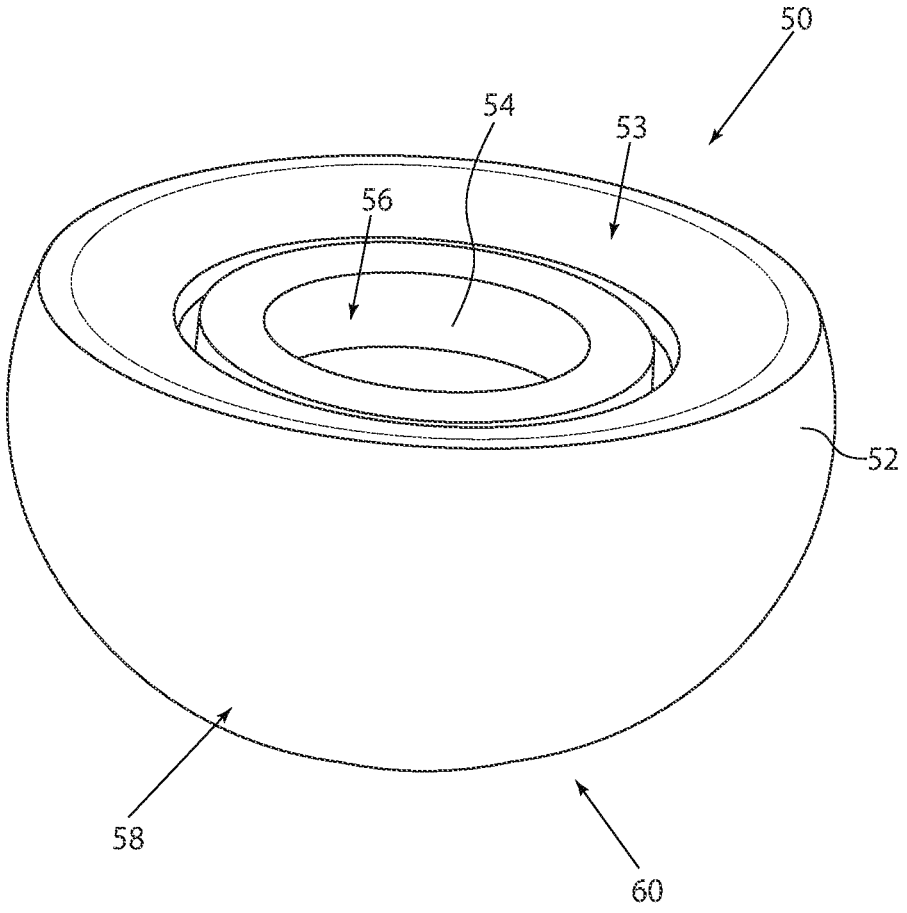
FIG. 2 is a perspective view of an internal chamber of a hookah bowl assembly according to one embodiment of the present invention.
Figure 5:
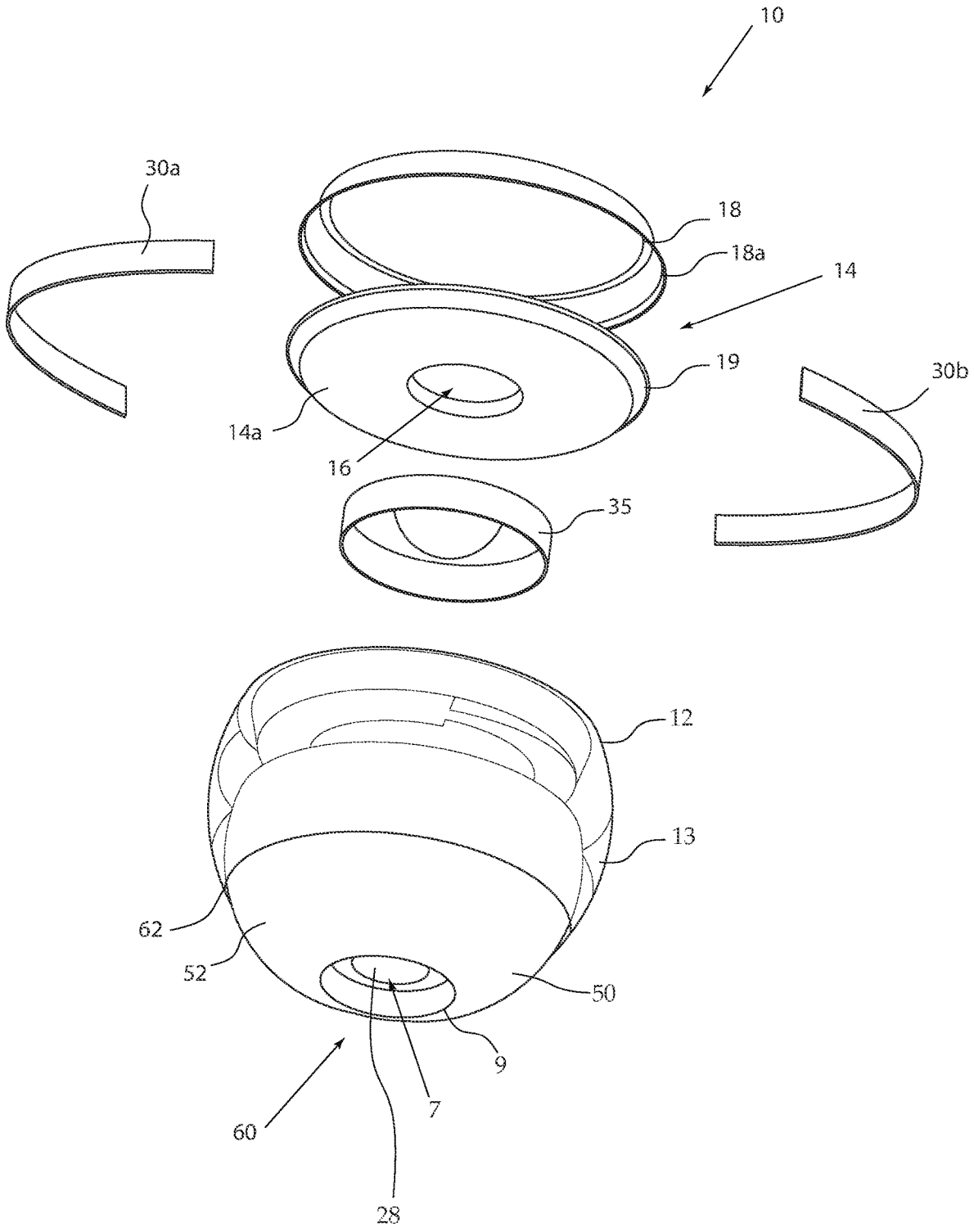
FIG. 5 is an exploded view of a hookah bowl assembly according to one embodiment of the present invention.
Figure 6:
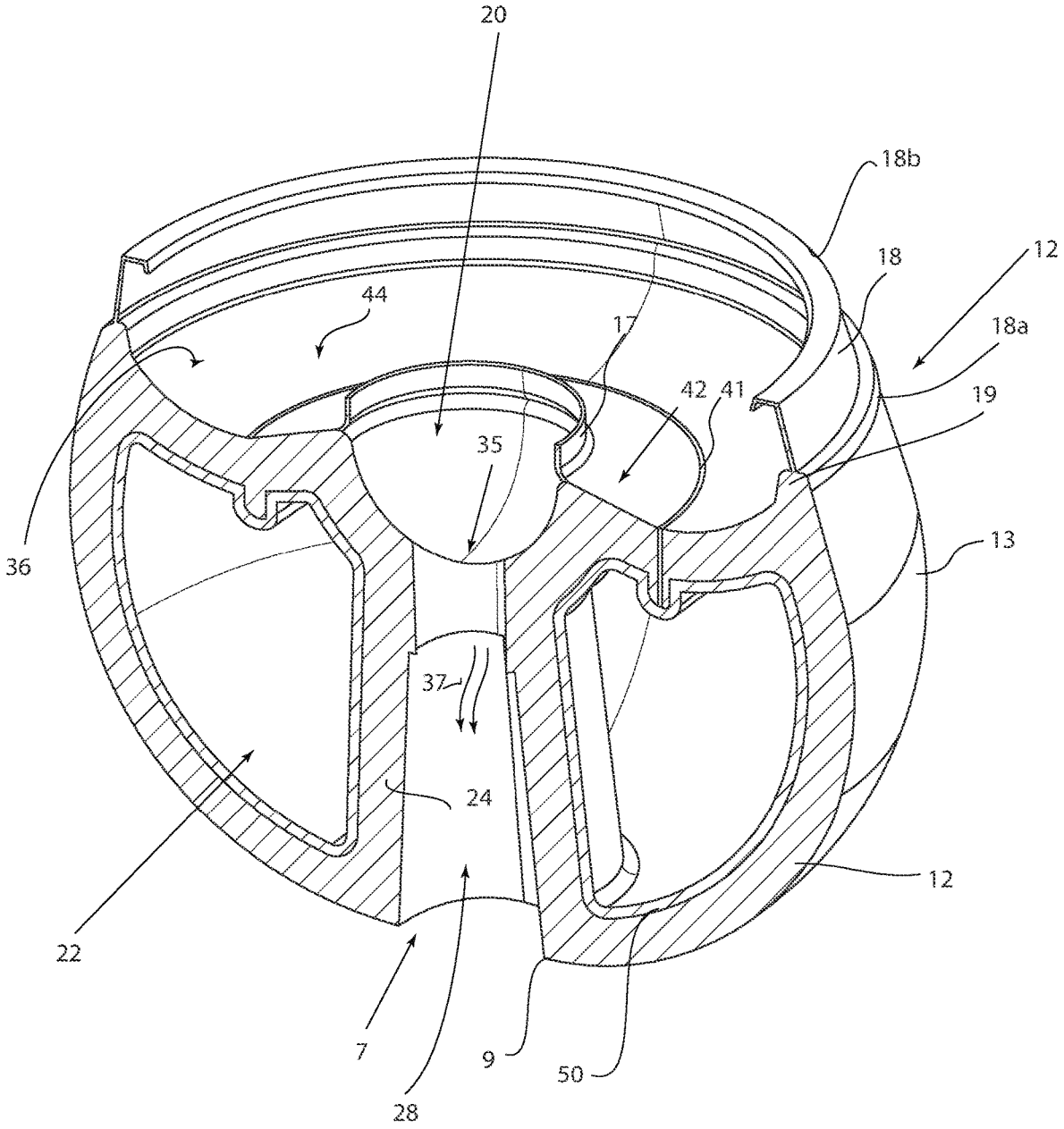
FIG. 6 is a perspective view of the top and interior portions of a bowl body of a hookah bowl assembly according to one embodiment of the present invention.

FIG. 2 illustrates the optional internal chamber 50, which would fit within interior cavity 22 (FIG. 6). The ternal chamber is preferably hollow made from a sidewall 52, which would be adjacent to the sidewall 13 of the body 12, when the internal chamber 50 is mounted within the bowl 12. Inner wall 54 corresponds to interior wall 24 of air channel 22. The top surface 53 may be substantially adjacent to the top surface 36 and the bottom end 60 may be adjacent to the bottom end 9 of the body 12, or as shown in FIG. 5 represents the bottom end 9. Channel 56 corresponds to and is of slightly larger diameter than the air channel 28. The hollow cavity 58 of the internal chamber 50 is configured to be filled or fillable with a measure of liquid, preferably a scented liquid. The liquid is intended to be chilled or frozen to cool the hot air flowing from the coal dish on top of the hookah device 46 through air channel 28.

FIG. 3. illustrates a sideview of the hookah bowl assembly 10 for use with a hookah device, comprising a silicone bowl head 12. The bowl 12 is shown having a hemispherical outer wall 15, between the bottom end 9, with the second rim 19 extending over the top end 14. The extension rim 18 is mounted over the second rim 19 using the lip 18*a*. The hemispherical outer wall 15 may be square, conical, trapezoidal, or pyramidal, or may assume a shape of a fruit with a top portion cut off to make room for the top end 14. The sidewall 15 is preferably finished in an uneven surface of a fruit peel.

Figure 4:
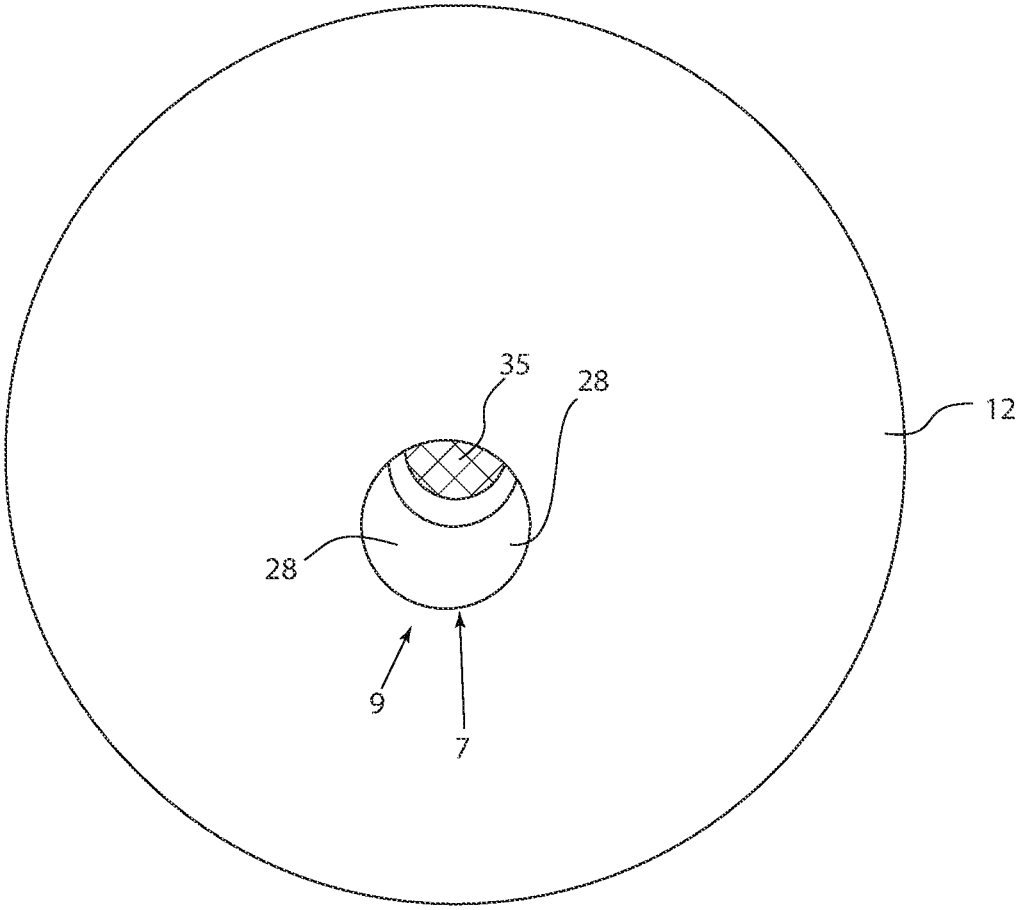
FIG. 4 is a bottom end of a hookah bowl assembly according to one embodiment of the present invention.
Figure 8:
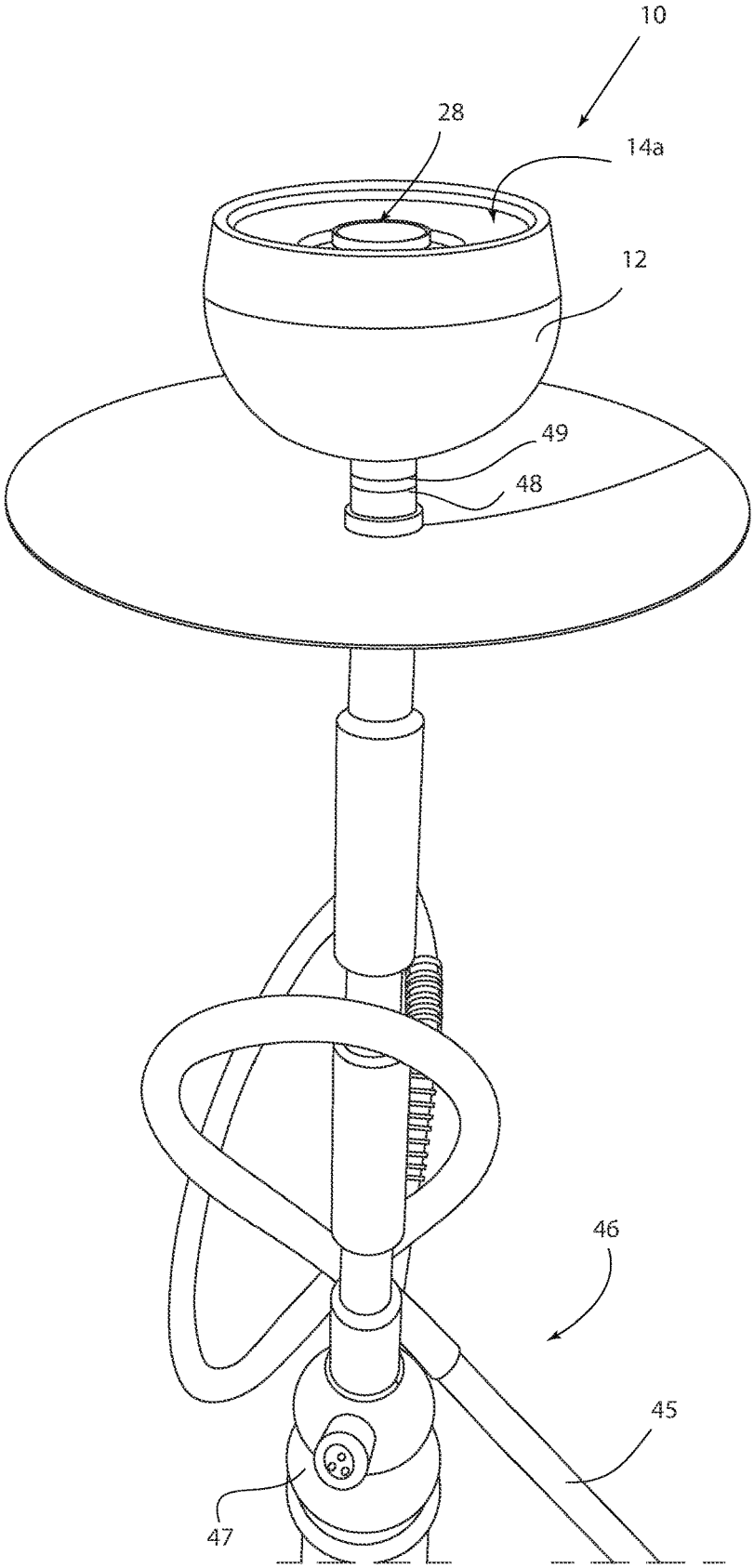
FIG. 8 is a perspective view of a bowl body of a hookah bowl assembly as coupled to a hookah device according to one embodiment of the present invention.

FIG. 4 illustrates, according to one embodiment, a bowl body 12 showing a air channel 28 from its bottom opening 7 which corresponds to the bottom end 9 of the bowl 12. The bottom opening 7 shows the underside of mesh screen 35 proximate to the top opening 16 of air channel 28. The bottom opening 7 is configured to be mounted onto the grommet 48 of the hookah air pipe 49 (FIG. 8).

FIG. 5 illustrates an embodiment similar to, or the same as, the embodiment described above connection with FIG. 1, showing an exploded view of hookah bowl assembly 10, in which the upper surface 14 is made in form of a dish 14*a* having a mesh screen 35 mounted below the top opening 16. Additionally, shown is partially connecting rings 30*a* and 30*b* which, when connected to each other, provide a seal for integrally holding bowl body 12 with the upper surface 14. An extension rim 18 together, which is preferably removable, is mounted on top of the second rim 19. In another embodiment, as shown in FIG. 6 (described below), extension rim 18 is coupled to outer second rim 19 of the sidewall 13 of the bowl body 12 via a threaded connection with the lip 18*a*.

Also shown in FIG. 5 is bowl 12 having a sidewall 13. In the embodiment shown the sidewall terminated at skirt 62 which is coupled to the sidewall 52 of the internal chamber 50. It is preferable that the transition between skirt 62 and the sidewall 52 is almost entirely smooth and transparent to an onlooker. In the embodiment shown, the bottom end 60 forms the bottom end 9 of the overall bowl 9, with the bottom opening 7 of air channel 28 visible through the bottom opening 7.

FIG. 6, described above, further illustrates an embodiment similar to, or the same as, the embodiment described above connection with FIGS. 1 and 2, showing a sectional view of bowl body 12 (in which to upper surface 36 is shown without the bowl dish 14*a*). The thickness of outer wall 13 has an inwardly curved slope. Bowl body 12 includes upper surface 36. The sidewall wall (outer wall 13) the top surface 36 and the bottom end 9, form the outer shell of the bowl body 12, with the interior wall 24 of the air channel 28 forming the inner shell of the bowl body 12. Outer and inner shells define an internal cavity 22 that is configured to contain a measure of liquid. The liquid preferably contains a scent or a combination of scents. The bowl 12 is designed to be removed from the air pipe 49 to be placed into a refrigerator or freezer to cool or freeze the liquid, which then has a chilling and cooling effect on hot vapor traveling from top opening 16 to the bottom opening 7 of air channel 28. Alternatively, an additional interior layer shown the internal chamber 50. The sidewall 13 and the internal wall are preferably impregnated with scent, which may be the same or different from the scent contained in the liquid.

In one embodiment, such as shown in FIG. 6, inner cavity 22 is a sealed cavity inside bowl body 12 that is configured to be filled with a liquid content to be chilled or frozen by any conventional means, such as, but not limited to, refrigeration. As heated smoke and air mixture 37, with hot air drown the foil layer containing a smoldering coal, which would be above the top surface 36, and which would have caused a smoking payload on the top surface 36 to emit smoke, passes through air channel 28 from the top opening 16 to the bottom opening 7, there is a thermal exchange, where the liquid get warmer from the heated air, while the heated air some heat will be transferred through inner wall 24 into the cooler lower lateral cavity 22. In the process the smoke air combination 37 is also perfumed with the scent from the liquid and the interior wall 24 and exterior wall 13 of the bowl 12.

In one embodiment, such as illustrated in FIG. 6, inner wall 24 has a conical shape having a smaller diameter proximate to the top opening 16 of air channel 28 and a wider diameter proximate to the bottom opening 7 of air channel 28. In another embodiment, interior wall 24 has a tubular shape.

In one embodiment, such as illustrated in FIG. 6, upper surface 36 of bowl body 12, central cavity 20 and central channel 28 are in air communication with each other and form one complete air channel through bowl body 12.

Figure 7:
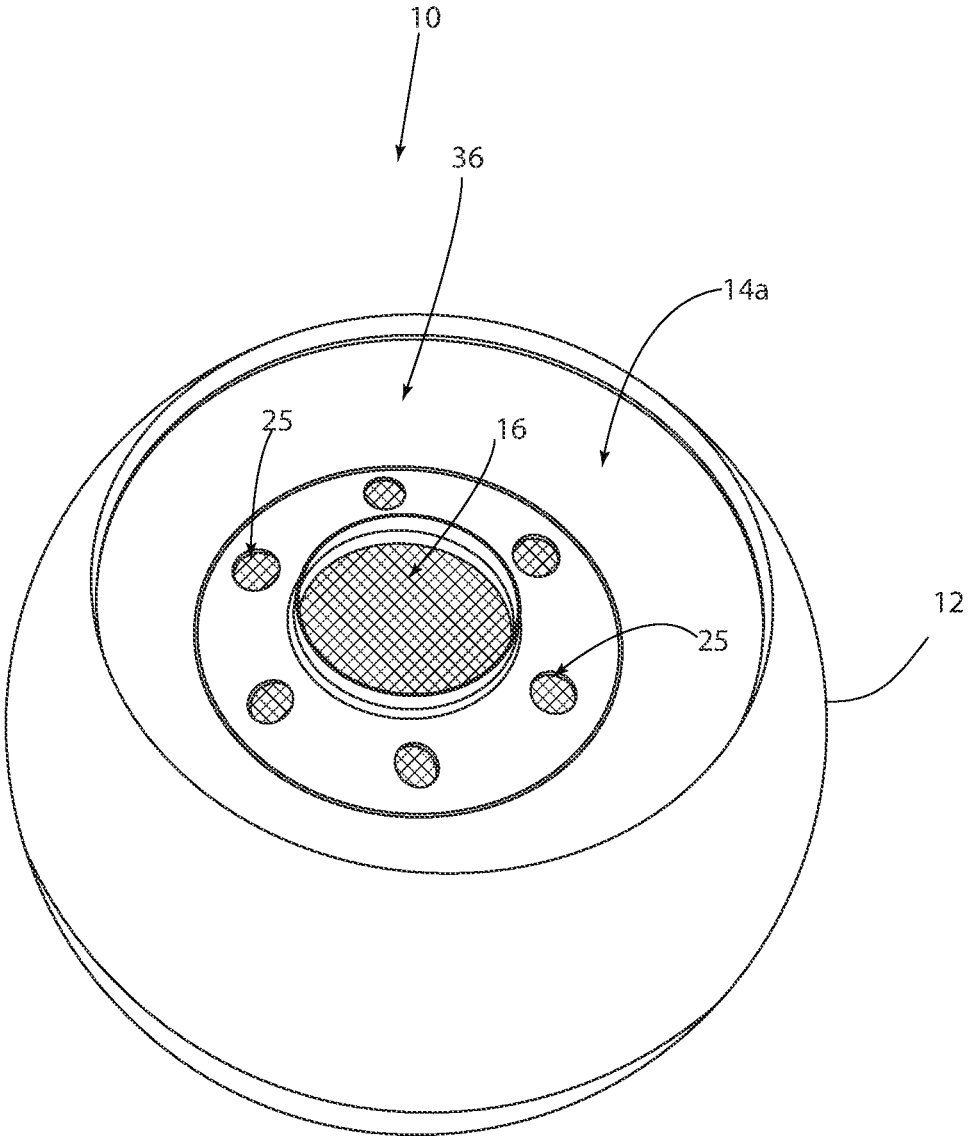
FIG. 7 is an alternative embodiment of the hookah head assembly, showing a plurality of openings along the top surface.

FIG. 7 illustrates an alternative embodiment similar to, or the same as, the embodiment described above connection with FIG. 1, in which bowl dish 14*a* (with central aperture 16 visible) is positioned above, and coupled to, bowl body 12. The top surface 24 further contains a plurality of smaller air openings 25.

FIG. 8 demonstrates the hookah head assembly 10, comprising the bowl body 12 is coupled to a hookah device 46 via a hookah grommet 48. The air pipe 49 and air channel 28 are in air communication. Thus, the ambient air bearing the smoke from the payload resting on the dish 14*a* travels through the air channel 28, where it is perfumed with scent from the bowl 12 and interior liquids within the bowl 12, and where it may also be cooled from the liquids within the bowl 12, through the air pipe 49, and into hookah bottle 47. With the suction supplied by a smoker inhaling through pipe 45.

Figure 9:
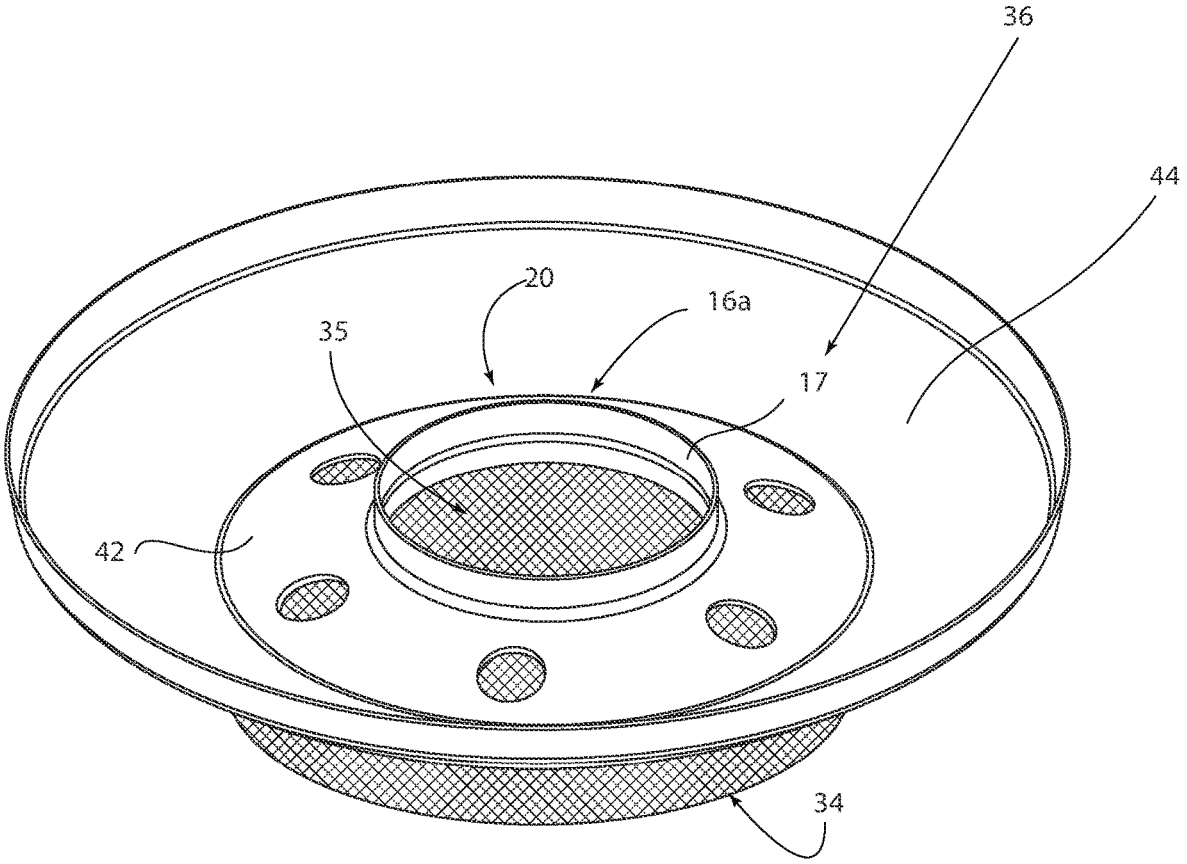
FIG. 9 is a perspective view of a bowl dish of a hookah bowl assembly according to one embodiment of the present invention.

FIG. 9 illustrates a bowl dish 14*a* similar to, or the same as, one or more of the embodiments described above in connection with the preceding figures. (See, for instance, FIGS. 1 and 5.) Bowl dish 14*a* includes a circular central aperture 16*a*, a substantially horizontal circular outer base 42, a first rim 17 between central aperture 16 and outer base 42, and an angled circular side wall 44. Together, outer base 42 and side wall 44 constitute an interior of the top surface 36 into which a user places tobacco to be smoked. As would be understood by a person having ordinary skill in the art, in light of the preceding figures, the underside of bowl dish 14*a*, dish stem 34 having a wire mesh screen (35), is positioned above, and in communication with, upper surface 36 described in FIG. 6 so as to extend at least partially into central cavity 20 of bowl 12. (See also FIG. 5.) The aforementioned alignment of central aperture 16*a*, central cavity 20 and air channel 28 thus allows smoke generated in the space above bowl dish (14) to be suctioned through hookah bowl assembly (10) and into the internal pipe of the hookah device (described above). Further details of the invention are provided below.

In one embodiment, bowl body (12) comprises silicone and bowl dish (14*a*) comprises a metal or an alloy. By using silicone, bowl body (12) as provided is insulated, shatterproof and will last longer as compared to bowl body that is constructed of clay, for instance.

Methods of impregnating or scenting silicone are known in the art. Reference herein to "scent" would be understood by a person having ordinary skill in the art as imparting both scent and flavor/taste. In one embodiment, the entirety or a substantial entirety of bowl body (12) is impregnated with a scent, such as grapefruit or other citrus or non-citrus fruit scents, or a combination of such scents, during or following the manufacturing process. Such other fruit scents may include, but are but not limited to, strawberry, blueberry, grape, raspberry, orange, watermelon, cantaloupe, honeydew or other known melon types, lemon, lime, mango, apple, green apple, kiwi, pear, pineapple, peach, apricot, cherry, plum banana, pomegranate, guava, papaya, carrot, and non-fruit flavors, such as, but not limited to, mint, cinnamon, vanilla, chocolate, and licorice, or a combination of any of the foregoing fruits, non-fruits or fruits and non-fruits. As referred to herein, a "combination of scents" refers to a combination of any two or more of the foregoing fruit flavors (e.g., raspberry lime), non-fruit flavors (e.g., cinnamon vanilla) or fruit and non-fruit flavors (e.g., orange mint).

As described above, during operation of a conventional hookah device, ambient air is pulled through the charcoals and into hookah bowl (12). In connection with the above-described embodiments of the invention, as heated air enters hookah bowl assembly (10), some of the aforementioned impregnated scent emanates from bowl body (12) and mixes with the newly formed smoke. In one embodiment, scent impregnated within inner wall (24) is drawn into central channel (28), at least partially from the suction force from the user, and mixes with smoke as the smoke is drawn through central channel (28).

In one embodiment, a conventional hookah bowl is substituted with a grapefruit-shaped and colored bowl, or shaped (and colored) like another citrus fruit whose flavoring is desired in the smoke. As described above, the outer wall (13) is impregnated with the scent corresponding to the fruit-shape adopted for the bowl construction. In one embodiment, the external texture of outer wall (26) of bowl (12) is constructed to resemble the external surface of the fruit whose flavoring is desired in the smoke. Such external structure may include a rough, uneven surface texture such as the appearance and feel of creasing or cracking. Alternatively, the texture may be smooth.

In one embodiment, bowl dish (14) is integrated with bowl body (12) so as to be non-separable. In the foregoing context of bowl body (12) and bowl dish (14), such "non-separable"configuration may also be referred to as being "integrally formed." In one embodiment, the underside of bowl dish (14) is fused, such as with heat, during the manufacturing process, to the upper surface (36) of bowl body (12). In another embodiment, bowl dish (14) is removably integrated with bowl body (12).

Although this invention has been described with a certain degree of particularity, it is to be understood that the present disclosure has been made only by way of illustration and that numerous changes in the details of construction and arrangement of parts may be resorted to without departing from the spirit and the scope of the invention. While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or lore of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, he to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims, as currently written or as amended or added in the future. Descriptions of exemplary methods or processes are not limited to inclusion of all steps as being required in all cases, nor is the order that the steps are presented to be construed as required or necessary unless expressly so stated.

What is claimed:

1. A hookah bowl assembly for use with a hookah device, comprising:

a bowl head comprising:

a body having a top end and a bottom end linked by a sidewall;

said sidewall defining an interior cavity; wherein said interior cavity configured to seal a quantity of liquid;

and wherein said interior cavity having an interior wall defining an air channel said air channel running from a top opening, said top opening at said top end of said body, until a bottom opening, said bottom opening at said bottom end of said body wherein said top end of said body comprising an upper surface said upper surface having a first rim and a second rim; wherein said sidewall, said upper surface and said air channel combine to retain said quantity of liquid within said interior cavity;

wherein said first rim defining said top opening of said top end of said air channel and wherein said second rim running in a parallel and set apart distance from said first rim; wherein said upper surface between said first rim and said second rim forming a general trough, said trough configured to receive a quantity of smoking payload;

wherein said top end of said air channel closed by a mesh material.

2. The hookah bowl assembly of claim 1, wherein said upper surface comprises a metal or a metal alloy composition.

3. The hookah bowl assembly of claim 1 further comprising an extension rim having a lower end, wherein said lower end of said extension rim is detachably coupled to said second rim of said upper surface.

4. The hookah bowl assembly of claim 1, wherein an outer surface of said sidewall is textured to resemble a fruit.

5. The hookah bowl assembly of claim 1, wherein said bottom end of said air channel is configured to detachably couple to a bowl grommet of said hookah device.

6. The hookah bowl of claim 1, wherein said air channel is conical.

7. The hookah bowl assembly of claim 1, wherein said bowl head comprises a silicone composition.

8. The hookah bowl assembly of claim 7, wherein said upper surface comprises a metal or a metal alloy composition.

9. The hookah bowl assembly of claim 8, wherein said upper surface forms a bowl dish and wherein said bowl head and said bowl dish are integrally formed.

10. The hookah bowl assembly of claim 9, wherein said silicone composition of said body or said air channel is impregnated with scent.

11. The hookah bowl assembly of claim 10 further comprising an extension rim having a lower end, wherein said lower end of said extension rim is detachably coupled to said second rim of said upper surface.

12. The hookah bowl assembly of claim 10, wherein said bottom end of said air channel is configured to detachably couple to a bowl grommet of said hookah device.

13. The hookah bowl assembly of claim 7, wherein said silicone composition of said body or said air channel is impregnated with scent.

14. The hookah bowl assembly of claim 13, said interior cavity further comprising an internal chamber; wherein said internal chamber disposed within said interior cavity between said sidewall and said interior wall; wherein said internal chamber configured to seal a quantity of liquid.

15. The hookah bowl assembly of claim 14, wherein malleability and texture of an outer surface of said sidewall is textured so as to resemble a fruit.

16. A hookah bowl assembly for use with a hookah device, comprising:

a bowl head comprising:

a hemispherical outer wall having a second rim;

an interior wall forming an air channel having a top opening and a bottom opening;

an upper surface comprising a first rim defining an opening of said top end of said air channel and said second rim; wherein said first rim and said second rim being in a parallel and set apart orientation to each other; wherein said upper surface substantially forming a trough around said top end of said air channel;

wherein said hemispherical outer wall, said upper surface and said air channel configured to retain a quantity of liquid within said interior cavity; and wherein said hemispherical outer wall or said interior wall impregnated with a scent.

17. The hookah bowl assembly of claim 16, wherein said outer and said interior wall are made from silicone.

18. The hookah bowl assembly of claim 17 wherein said top surface is made out of a metal alloy and wherein said top surface and said outer wall and said interior wall being unitary.

19. The hookah bowl assembly of claim 18 wherein said top end of said air channel having a generally concave opening, said concave opening lined with a mesh surface.

20. The hookah assembly of claim 17, wherein said trough further comprising air openings; said air opening being in communication with said air channel and wherein said air openings covered with a mesh material.

* * * * *